US008127840B2

(12) United States Patent
Crihan et al.

(10) Patent No.: US 8,127,840 B2
(45) Date of Patent: Mar. 6, 2012

(54) CONDUCTIVE HEATING BY ENCAPSULATED STRONTIUM SOURCE (CHESS)

(76) Inventors: Ioan G. Crihan, New York, NY (US); Geoffrey G. Woods, Fairfield, CT (US); Jerrold E. Hyams, New York, NY (US)

( * ) Notice: Subject to any disclaimer, the term of this patent is extended or adjusted under 35 U.S.C. 154(b) by 0 days.

(21) Appl. No.: 12/944,864

(22) Filed: Nov. 12, 2010

(65) Prior Publication Data

US 2011/0061859 A1 Mar. 17, 2011

Related U.S. Application Data

(63) Continuation-in-part of application No. 12/078,669, filed on Apr. 3, 2008, now abandoned.

(60) Provisional application No. 60/845,160, filed on Jan. 9, 2008.

(51) Int. Cl.
*E21B 43/24* (2006.01)

(52) U.S. Cl. ..... 166/247; 166/302

(58) Field of Classification Search ..... None
See application file for complete search history.

(56) References Cited

U.S. PATENT DOCUMENTS 3,347,711 A * 10/1967 Banks, Jr. et al. ..... 136/202
3,377,207 A * 4/1968 Stathoplos ..... 376/320
3,663,306 A 5/1972 Des Champs et al.
6,455,013 B1 9/2002 Crihan

* cited by examiner

*Primary Examiner* — Zakiya W Bates

(57) ABSTRACT

The present invention deals with a method to liquefy the viscous oil of oil wells and also to clean the paraffin off the walls of tubing and other production equipment. The method consists in using heat produced by a thermal generator, and also using steam produced by the contact between the thermal generator and water. The thermal generator is a metallic shielded container of cylindrical shape holding individual units of already encapsulated Strontium-90 sources able to generate a temperature of 100 degree Celsius or a combination of encapsulated Strontium-90 sources able to generate 100 degree Celsius each in order to obtain, according to necessities, up to or over 600 degree Celsius. The thermal generator is transported in a metal housing.

18 Claims, 2 Drawing Sheets

CONDUCTIVE HEATING BY ENCAPSULATED STRONTIUM SOURCE (CHESS)

CROSS REFERENCE TO RELATED APPLICATIONS

This application is a continuation in part of U.S. patent application Ser. No. 12/078,669 filed Apr. 3, 2008, now abandoned which claims the benefit of U.S. Provisional Application 60/845,160, filed Jan. 9, 2008. Each of these related applications is incorporated herein by reference.

Encapsulated Strontium sources presently available can generate heat to about 100 degree Celsius temperature. The sources may be combined, according to necessities, to obtain up to 600 degree Celsius temperature. Strontium 90 is a product of nuclear fission. It is present in significant amounts in spent nuclear fuel, in radioactive waste from nuclear reactors and in nuclear fallout from nuclear tests. It finds extensive use in medicine and in industry. The radioactive decay of Strontium-90 generates a significant amount of heat and is used as a heat source in many radioisotope thermoelectric generators. The main advantage of Strontium 90 is that it is cheaper than alternative sources, such as Cesium 137, is found in nuclear waste, and has been proven efficient in generating heat.

Strontium 90 is currently available in encapsulated form from various sources. The current invention preferably uses existing Strontium 90 sources that have already been encapsulated into individual units. Typical units measure 2.6 inches diameter (on the outside) and 20.8 inches length (outside) and exist in cylindrical shape. The present invention is concerned with using the encapsulated sources of Strontium 90 to create for example a tube shaped thermal generator as a heat source. This heat source would then be lowered down inside the oil well at various depths.

The thermal generator is preferably transported to the processing site in a metal housing 40 as shown in FIG. 5, incorporated herein by reference in U.S. Pat. No. 6,455,013, issued on Sep. 24, 2002. FIG. 5 shows of transportable trailer 41 having a drawing tractor 42 for bringing the irradiation chamber which is suitably housed in a clad housing to a processing site. The trailer has a removable protective roof 43 which may be removed by crane 44 in order to load or unload the radioisotope source (at 45) (Strontium 90). The radioisotope source is kept in locked containers 45, which may be the same as container 20 or may house the container 20 inside the trailer during the transportation. The metallic housing 40 (FIG. 5) has been adapted to prevent any nuclear or thermal radiations from leaking out. When not in use, the encapsulated sources of the thermal generator are preferably stored at an appropriate nuclear facility.

This invention may be particularly used in the petroleum extraction industry among other applications. It uses radioisotope heat technology to liquefy the oil wells, to clean paraffin off the tubing walls, and to generate steam for a various uses. Almost every working oil well experiences problems with paraffin build up on the inside of the production tubing. This build up may occur on the inside surface of the production tubing or also on the sucker rod, which reciprocates within the tubing. This paraffin buildup forms a restriction in the tubing and reduces the productivity of the oil well. Consequently, almost every oil well must be periodically serviced or as necessary to remove the paraffin build up or to liquefy the viscosity of oil in order to permit the free flow of oil through the production tubing.

This invention brings forth a method for oil recovery by reducing restrictions to the mobility of the oil in order to increase production. The process of oil recovery starts with cleaning up the paraffin inside the surface of the production tubing and the sucker rod by heating the paraffin past its melting temperature. This is done with a small thermal generator containing preferably one or, if necessary, two Strontium 90 sources (FIG. 1). After the cleaning of the paraffin, the temperature of the thermal generator needed to further produce the necessary steam for melting the viscosity of the oil must be determined. The temperature may be established by the parameters of the well measured at the site, theoretical calculations or by reference to charts, etc. The heat is thus used to increase the efficiency of these wells, especially wells that have been abandoned because of too much viscosity.

The invention described herein provides for the mobility of the Strontium 90 thermal generator and also on the variety of its temperature to meet the demands of diverse and remote wells.

DETAILED DESCRIPTION

Almost every working oil well experiences problems with paraffin build up on the inside of the production tubing. This build up may occur on the inside surface of the production tubing or also on the sucker rod which reciprocates within the tubing. Current heat sources used at well sites are not capable of providing sustained heat at the depth and operating temperatures of wells where the heat is needed because they are not self-generating heat sources.

Figure 5:
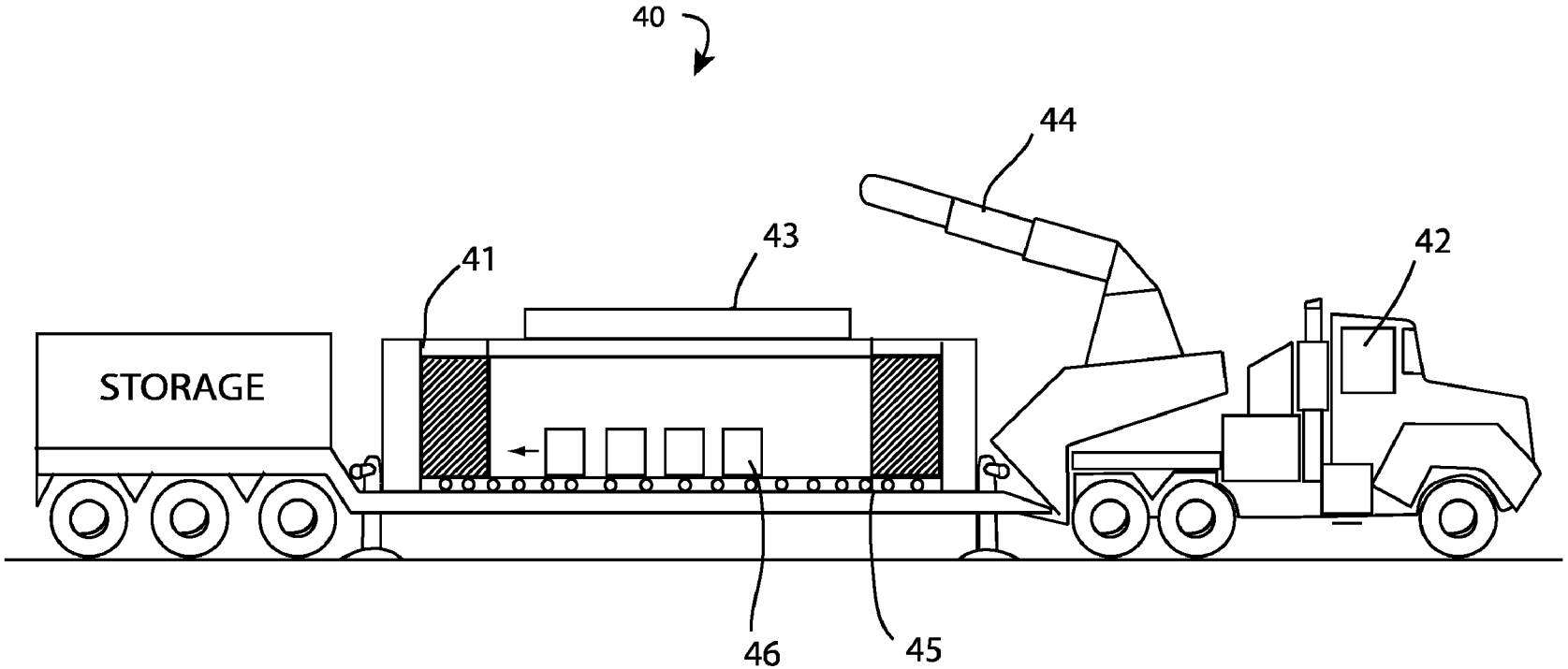
FIG. 5 is the mobile housing used for transportation from the nuclear facility to the processing site.

Therefore, there exists a need to return the wells to efficient working order that can provide the heat required in the closed environments of the wells. The present invention is to a apparatus and method to liquefy the viscosity of the oil well at the reservoir level and to clean the paraffin off the walls of the production tubing, and from other portions of the well equipment. Whenever necessary, a thermal generator 10 (FIG. 1) containing one or more radioactive sources of Strontium 90 is brought to the processing site by a vehicle especially equipped to handle the material (FIG. 5).

Strontium 90 is a product of nuclear fission and is preferably used in the process described below. Strontium is present in significant amounts in spent nuclear fuel, in radioactive waste from nuclear reactors and in nuclear fallout from nuclear tests. It finds extensive use in medicine and industry. Since the radioactive decay of Strontium-90 generates significant amount of heat, it is used as a heat source in many radioisotope thermoelectric generators. However, what is needed in the present invention is a self-generating heat source that can be safely and efficiently applied at the location of the problem. A significant advantage of Strontium 90 is that it is cheaper than alternative sources, such as Cesium 137, is portable and is efficient in heat generation.

Encapsulated Strontium 90 sources 12 may be purchased from one of a number of special facilities, such as Waste Encapsulation and Storage Facility (WESF). The sources may then be delivered by that facility, WESF or other, to the nearest nuclear laboratory of the processing site where the sources can be assembled in individual thermal generators of different temperature capacity. While the sources are typically delivered in 100° C. units, one skilled in the art would appreciate that any temperature from 0 to 600 C and above is contemplated by the present invention.

At the nuclear laboratory, the thermal generators are placed into shielding containers 20 with a lead inner wall 22 to protect against radiation and ceramic outer wall 24 to protect against heat to prepare the units for transportation to the sites and their applications at the site. These shielding containers are placed in the mobile housing 40 (FIG. 5) to be transported to the processing site in storage units that may also be shielded or have other safety devices to protect the shielding containers during transportation and for protection in the case of an accident.

In practice, an engineer at the well or other staff on a periodic basis may perform checks and/or determine that paraffin buildup in the well 60 has occurred or that other restrictions have lowered the efficiency of a well. To repair the well, the heating system is transported to the processing site by the mobile housing for cleaning.

Figure 3:
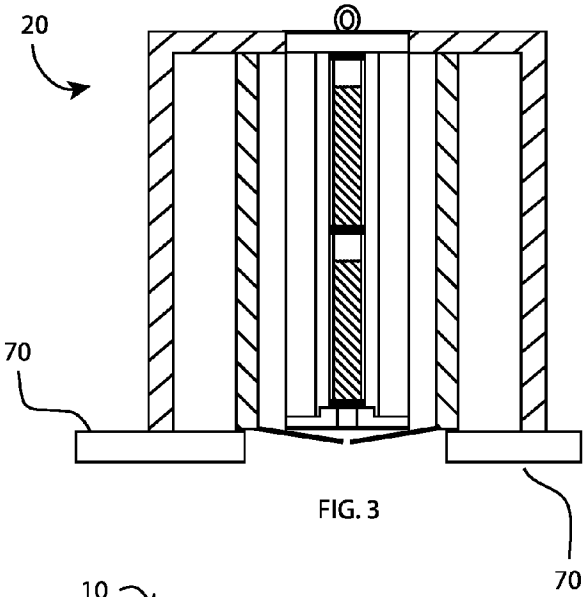
FIG. 3 shows a thermal generator within a shielding container and installed on a rack.
Figure 2:
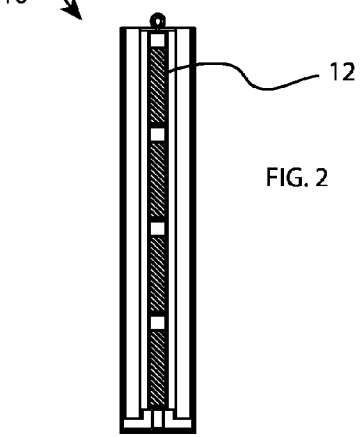
FIG. 2 shows a thermal generator containing four encapsulated strontium sources with the process described in the preferred embodiment of the invention.
Figure 1:
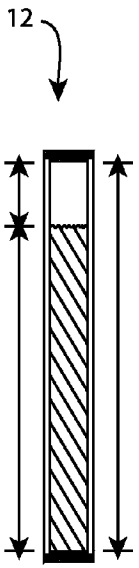
FIG. 1 shows a thermal generator with an individual strontium source for insertion encapsulated units with the process described in the preferred embodiment of the invention.
Figure 4:
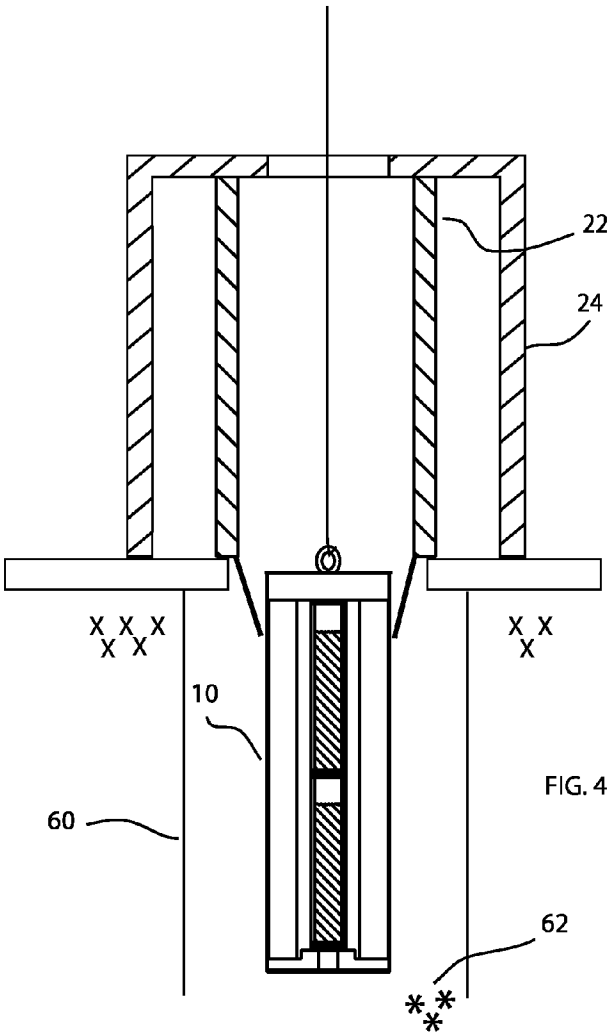
FIG. 4 shows a thermal generator released from the shielding container through the rack.

The thermal generator 10 is a metallic container made up of steel, preferably having a vertical cylindrical shape and being adapted to incorporate one or up to 6 Strontium 90 sources 12 (FIG. 1). It is preferred that a maximum of six sources are capable of being inserted into the thermal generator. The sources preferably have already been encapsulated in individual cylindrical units of 2.6 inches diameter and 20.8 inches length are inserted into the thermal generator at a laboratory prior to shipment to the site according to requirements provided by for example the site engineer. Alternatively, a number of permutations of thermal generators with different numbers of encapsulated Strontium sources are selected for transportation to meet the need of the site. The tube-shaped thermal generator 10 holds the Strontium 90 sources that are placed within the length of the tube, with each source occupying its own space. The length of the thermal generator may vary according to the number of Strontium 90 sources or may utilize. The tube-shaped thermal generator is then placed into a shielded, transportation container 20 with lead inner wall 22 to protect against radiation and with a ceramic outer wall 24 to protect against heat during travel.

Once at the site and the condition of the well is determined, the proper temperature for use in cleaning the well may be selected, if not previously determined. Paraffin is a waxy solid, with a typical melting point between about 47° C. and 64° C. (117° F. to 147° F.). The thermal generator can produce a constant temperature of 100° C. or more (212° F.) for treating the paraffin, and up to 600° C. (1112° F.), for treating the viscosity of oil. In this way the desired temperatures can be produced by adding for example together up to six Strontium 90 encapsulated sources, generating 100° C. each, to the thermal generator. One skilled in the art would recognize that although units of 100° C. are discussed, by varying the amount of heating material or by altering the amount of insulation around the material, any temperature from 0 to 600° C. or above could be generated by a thermal generator.

At the processing site, before the thermal generator is unloaded from the mobile housing 20, the well tubing must be covered with a metallic horizontal rack 70. The rack preferably includes a hole aligned with the well bore 60 to allow the thermal generator to be inserted down the well through for example existing tubing. The metallic racks typically are maintained by oil extraction sites or could be kept as a tool in the storage of the mobile housing.

The thermal generator, covered by its shielding container with protective inner wall of lead and outer wall of ceramic is placed over the metallic rack 70 covering the oil well as shown in FIG. 1. The lead inner wall protects the environment and the humans against radiation while the ceramic outer wall protects them against heat. The thermal generator 10 may then be inserted into the well. In a preferred method, the thermal generator is hooked to a cable to be lowered down the well for cleaning the paraffin. The bottom of the shielding container may be opened mechanically or by other methods. The cable hooking the thermal generator allows the interior thermal generator and encapsulated Strontium units to slide down through the hole of the rack along the well bore 60 to clean/melt the paraffin. After cleaning the paraffin 62, the initial thermal generator is put back into the mobile housing, together with its shielding container by reversing the insertion process. Then, the parameters of the oil well may be re-evaluated to establish an amount of steam and the time required to improve the viscosity of the oil in the particular well, if necessary.

The thermal generator, covered by its shielding container with protective inner wall of lead and outer wall of ceramic is placed over the metallic rack 70 covering the oil well. The lead inner wall protects the environment and the humans against the radiation; the ceramic outer wall protects them against the heat. The thermal generator is then hooked to a cable and to a water pipe of approximately 12 feet long. The unit is then lowered down the well 60 for treating the viscosity of oil with steam. The water pipe has a metallic structure designed to resist high temperature. This metallic pipe is connected to a plastic tube which transports water down to the thermal generator. The bottom of the shielding container will again be opened mechanically. The cable hooking the thermal generator and the water pipe lets them slide down through the hole of the rack to the bottom of the oil well. At the contact of water with the hot surface of the thermal generator, water transforms into steam to be used for as long as necessary. This method is unlike previous heating elements which cool with time and thus cannot provide sustained steam production downhole.

Unlike the traditional methods which use tubing and pressure to send the hot water or steam to the reservoirs, the present invention produces the steam continuously, at the bottom of the reservoir itself. Furthermore, this new invention is revolutionary in its using Strontium-90 sources with a half life of 28.8 years as a heat source that produces steam. The radioactive decay of Strontium-90 generates significant amount of heat and is cheaper than the alternatives.

The present invention was designed according to the standards of the high technology apparatus that require applying the method by simple means, at low cost and in the shortest period of time.

Unlike the existing methods which produce steam at the ground level and then send it down to the bottom of the well, the new device eliminates the concerns that the steam may condense at the lower temperatures of the well environment. Moreover, the new invention was designed to create constant heat and steam for as long as necessary. This is possible only because the thermal generator contains encapsulated Strontium-90 sources with a half life of 28.8 years.

We claim:

1. A method of liquefying viscous oil in a down hole well comprising:

providing at least one encapsulated Strontium 90 source;

storing at least one of the Strontium 90 sources having a first stabilized temperature in an individual thermal generator unit;

placing the thermal generator unit in a first shielding container of a predetermined size and shape, wherein said shielding container has a lead wall and a ceramic wall, each wall surrounding the enclosed thermal generator;

heating the thermal generator from within by Strontium 90 radiation to the first stabilized temperature;

transporting shielding container and thermal generator to the down hole well;

lowering the thermal generator from the shielding container into the down hole well.

2. The method of claim 1, wherein the thermal generator unit contains an amount of encapsulated Strontium 90 source to heat the thermal generator to the first stabilized temperature, wherein the first stabilized temperature is approximately 100 C.

3. The method of claim 1, further comprising:

storing a second of the at least one encapsulated Strontium sources in a second individual unit in the thermal generator, wherein said second encapsulated Strontium source has a second stabilized temperature;

transporting the first heated encapsulated Strontium 90 source and the second heated encapsulated Strontium 90 source in the thermal generator to a location of the down hole well to melt paraffin from the well.

4. The method of claim 3, wherein the encapsulated Strontium source contains an amount of Strontium 90 sufficient to heat the thermal generator to a stable temperature of more than 100 C and said thermal generator melts paraffin from walls of tubing and production equipment in the well.

5. The method of claim 3, wherein each of the first and second encapsulated Strontium sources contain an amount of Strontium 90 to generate a stable temperature of at least 100 C.

6. A method of heating a portion of a down hole well, comprising:

providing a Strontium 90 source;

encapsulating amounts of the Strontium 90 in a plurality of individual encapsulated units;

determining a desired application temperature between 100 and 600 C at a site within the well;

selecting a number of the plurality of individual encapsulated units that combine to provide at least the desired application temperature;

placing the selected number of individual units in a thermal generator;

heating the thermal generator from within by Strontium 90 radiation and allowing the temperature of the metallic structure to stabilize at approximately the desired application temperature;

transporting the thermal generator to the down hole well and inserting the thermal generator in the down hole well to heat a site in the well to approximately the desired application temperature.

7. The method of claim 6, wherein each of the individual encapsulated units contain a substantially equal amount of the Strontium 90 source.

8. The method of claim 7, wherein the thermal generator is tube shaped.

9. The method of claim 6, wherein the thermal generator melts at least some paraffin within the well.

10. The method of claim 6, wherein each of the units contain an amount of Strontium 90 source to heat the thermal generator to a stabilized temperature of at least 100 C.

11. The method of claim 6, wherein the desired application temperature is approximately 600 C.

12. The method of claim 6, wherein heating of the well is maintained until some paraffin in the well is melted in the well.

13. The method of claim 6, wherein heating of the well is maintained until paraffin in the well is melted to reduce blockage in the well.

14. The method of claim 6, wherein heating of the well is maintained until paraffin covering at least one cable in the well melts.

15. A method of providing heat down hole in a well comprising:

providing a Strontium 90 source having a stabilized temperature;

encapsulating at least an amount of the Strontium 90 and placing the encapsulated Strontium in a first encapsulated source unit;

transporting the encapsulated source unit to the down hole well in a metal and ceramic housing;

heating the encapsulated source unit from within by Strontium 90 radiation to the stabilized temperature;

removing the encapsulated source unit from the metal and ceramic housing;

lowering the encapsulated source unit into the well by a cable;

connecting a water tube with the cable holding the thermal generator down the well;

heating water to steam by bringing the water from the water tube in close proximity to the encapsulated source unit;

directing the heated steam to a desired location of the well to heat the well.

16. The method of claim 15, wherein steam is directed onto viscous oil in the well to liquefy the viscous oil to reduce oil flow blockage in the well.

17. The method of claim 15, wherein steam is directed to the desired location until the viscous oil of the well is completely liquefied.

18. The method of claim 15, wherein steam is directed to the bottom of the well.

* * * * *